US005690239A

United States Patent [19]

Ballard

[11] Patent Number: 5,690,239

[45] Date of Patent: Nov. 25, 1997

[54] MULTI-PURPOSE COLUMNAR SUPPORT

[76] Inventor: Donald M. Ballard, 16700 Tinker Pl., Huntersville, N.C. 28078

[21] Appl. No.: 652,989

[22] Filed: May 24, 1996

[51] Int. Cl.[6] ..... A47F 5/00

[52] U.S. Cl. ..... 211/189; 211/94; 211/87; 211/193; 211/187

[58] Field of Search ..... 211/189, 94, 90, 211/193, 187, 205, 162, 87

[56] References Cited

U.S. PATENT DOCUMENTS

| | | | |
|---|---|---|---|
| 3,297,374 | 1/1967 | Radek | 211/187 X |
| 3,351,313 | 11/1967 | Guillon | 108/106 |
| 3,458,052 | 7/1969 | Kann | 211/193 |
| 3,896,743 | 7/1975 | Pariente | 211/186 X |
| 3,968,882 | 7/1976 | Mello | 211/189 |
| 4,065,904 | 1/1978 | Taylor et al. | 211/193 X |
| 4,508,231 | 4/1985 | Honickman | 211/87 X |
| 4,570,390 | 2/1986 | Wendt | 211/190 X |
| 4,585,131 | 4/1986 | Crossman et al. | 211/189 X |
| 4,638,606 | 1/1987 | Wendt | 211/90 X |
| 4,805,783 | 2/1989 | Mayer | 211/94 |
| 4,891,897 | 1/1990 | Gieske et al. | 211/87 X |
| 5,228,579 | 7/1993 | Kaufman | 211/87 X |
| 5,337,903 | 8/1994 | Wolcovitch et al. | 211/87 X |
| 5,370,249 | 12/1994 | Harvey et al. | 211/189 |

*Primary Examiner*—Robert W. Gibson, Jr.
*Assistant Examiner*—Long Dinh Phan
*Attorney, Agent, or Firm*—Clifton Ted Hunt

[57] ABSTRACT

The multi-purpose columnar support of this invention is an aesthetically pleasing structural support primarily adapted for use in creating displays for merchandise in stores and exhibits. A tubular column extruded from heavy gauge metal or other structural material and cut to any desired length is the principal element of the columnar support. The diameter of the column is three inches in the illustrated embodiment, but may be of any desired diameter. The extruded column has a core and four holding areas that diverge outwardly from the core to the cylinder wall and support connectors selected from a group of connectors that are each configured to engage and support one or more items of conventional hardware, such as brackets, slotted strips, slatwalls, decorative panels and wire slat grid panels, that are used in the display of merchandise, The unused holding areas are closed by trim caps to provide the appearance of a substantially solid column with an unbroken surface except for the active holding areas.

11 Claims, 10 Drawing Sheets

MULTI-PURPOSE COLUMNAR SUPPORT

FIELD OF THE INVENTION

The columnar support of this invention finds its principal utility in the support of conventional hardware used for the display of merchandise in stores and the exhibition of products in trade shows.

BACKGROUND OF THE INVENTION

Slatwalls, wire slat grid panels, decorative panels, slotted strips and brackets of various types, including shelving brackets, are items of conventional hardware that have long been used to support merchandise for display in stores and at exhibits or trade shows and are recognized as conventional items in the shelving industry.

Supports for these items are conventionally custom-made, at considerable expense in time and money, to blend with the surrounding environment and be aesthetically pleasing to attract potential customers.

In an effort to avoid the time and expense of making a custom-made support for each display of merchandise, it is known to extrude columns having one or more radial openings, as required, for different types of displays. For example, if merchandise is to be displayed on a slatwall extending between two columns, the prior art would provide two extruded columns, each having just one radial opening. The columns with one radial opening had an otherwise smooth outside wall that presented an attractive appearance. In the present example, the two columns would be positioned with their respective radial openings facing each other to receive supports for the slatwall.

Of course, the columns with just one radial opening could not function to support slatwalls extending from opposite sides of the column. The prior art would then provide extruded columns having two oppositely directed radial openings with an otherwise smooth outside wall to achieve the desired attractive appearance.

Some displays of merchandise use columnar supports having openings on three sides. For example, two slotted strips in oppositely directed radial openings in a column and one end of a slatwall supported in one radial opening between the openings for the slotted strips. The prior art would extrude a column with three radial openings for this purpose. The column with three radial openings could be used to support only one end of a slatwall or to support only one slotted strip, but the average merchandiser would not accept a column with exposed openings that were not used to support something because a column with exposed and unused openings does not have a satisfactory appearance of completeness.

It is an object of this invention to provide apparatus that can be readily adapted to support items on any side of the column and conceal any openings in the column that are not used. The apparatus of this invention has the advantage of simultaneously providing reliably sturdy support for a variety of conventional hardware items with minimal effort while providing the aesthetically pleasing appearance of a solid column, except for the openings with connectors that support hardware.

SUMMARY OF THE INVENTION

The principal element of this invention is an elongated tubular column extruded from heavy gauge metal or other structural material and cut to any desired length. The column may be of any desired diameter, for example three inches.

The column is extruded with four cross arms that diverge radially from the corners of a square core penetrated by an axial bore. The four diverging arms terminate in arcuate segments that form spaced portions of the outer wall of the column. The diverging areas between the arms become the spaces between the arcuate segments that form portions of the cylinder wall.

The outwardly diverging areas serve as holding areas that are configured to engage and support elongated connectors that are, in turn, configured to engage and support slatwalls, wire slat grid panels and other items conventionally used in the display of merchandise. Unused holding areas are concealed by trim caps to provide the appearance of a solid column, except for the active holding areas, for aesthetic purposes.

DETAILED DESCRIPTION OF THE INVENTION

The columnar support of this invention comprises a tubular column, broadly indicated at 30, that is formed with four shaped spaces that function as holding areas to slidably receive at the same time as many as four elongated connectors. The inner portions of the connectors are shaped to be slidably received in the holding areas and the outer portions of the connectors are configured to register with and engage assorted items of hardware used in the erection of booths and displays of merchandise, such as panels P (FIG. 9), slatwalls S (FIG. 2), slotted strips L (FIG. 19), brackets B and $B^1$ (FIG. 2), and wire slat grid panels W (FIG. 15) (collectively referred to hereinafter as "conventional hardware").

Figures 25, 26:
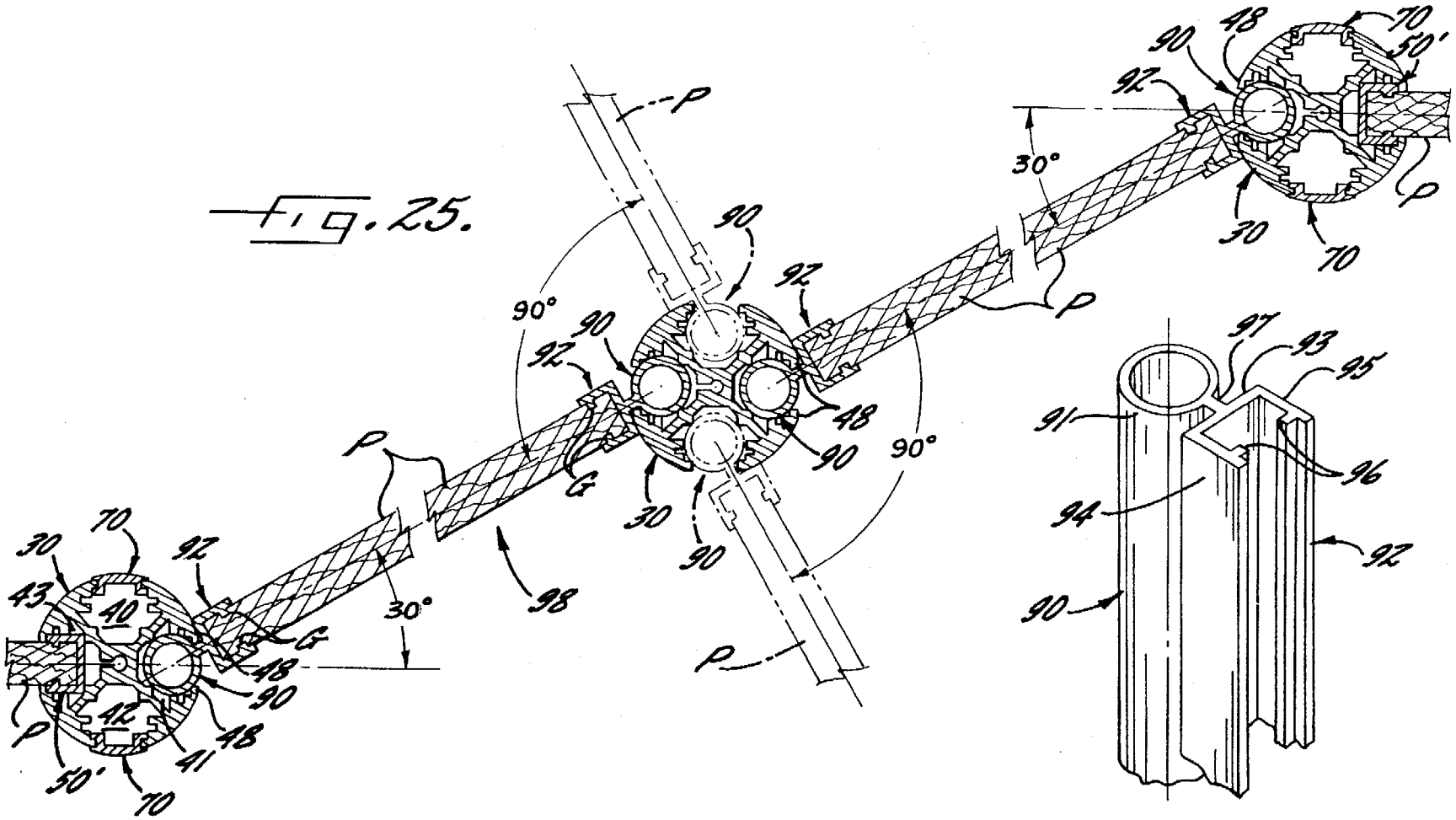
FIG. 25 is a top plan view illustrating the use of pivotal connectors with columnar supports for fastening panels at variable angles to form a self-supporting partition or display without the need for a supporting base, and showing the use of inverted channels and pivotal connectors connecting panels to the same column, with trim caps closing the unused holding areas.
FIG. 26 is a perspective view, with parts broken away, of the pivotal connector shown in FIG. 25.

The elongated connectors for the column 30 include slotted channels 50, internal channels $50^1$, slotted strips L, reinforced slotted strips R, double-wall channels 60, trim caps 70 and pivotal connectors 90 (FIG. 26). Planar connectors 80 (FIGS. 23 and 24) are also used as pivoting connectors. The columnar support also includes a variety of finials F and bases 100.

The column 30, slotted channels 50, slotted strips L, internal channels $50^1$, double-wall channels 60, trim caps 70 and pivotal connectors 90 are preferably extruded from heavy gauge aluminum or other suitable structural material. The reinforced slotted strips R are made of ⅛ inch thick steel with 1/16 inch thick angle irons welded to them. The planar connector 80 is a flat plate of metal or other suitable material. The finials F are preferably formed from the same material as the column 30. The bases 100 may be formed from any desired material that is sturdy enough to support the completed assembly.

The Column

Figure 3:
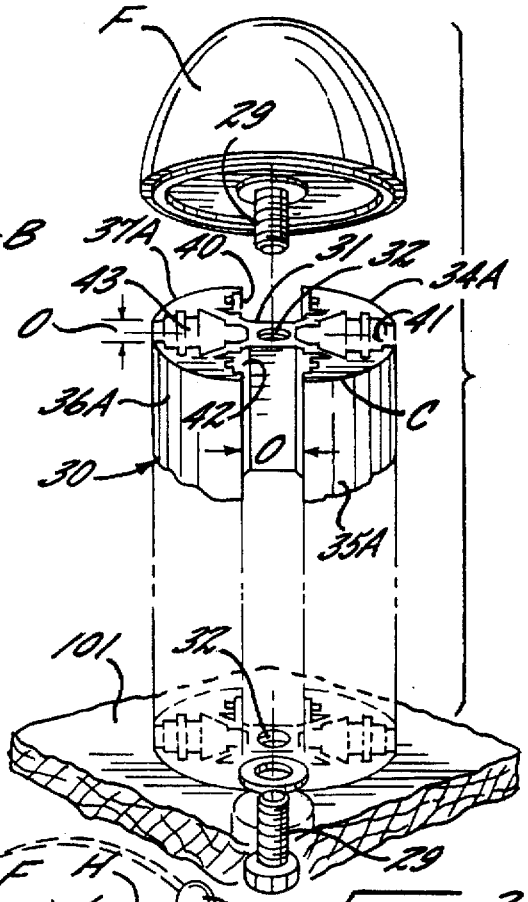
FIG. 3 is an enalarged exploded view, with parts broken away, showing the top and bottom of a columnar support.
Figure 4:
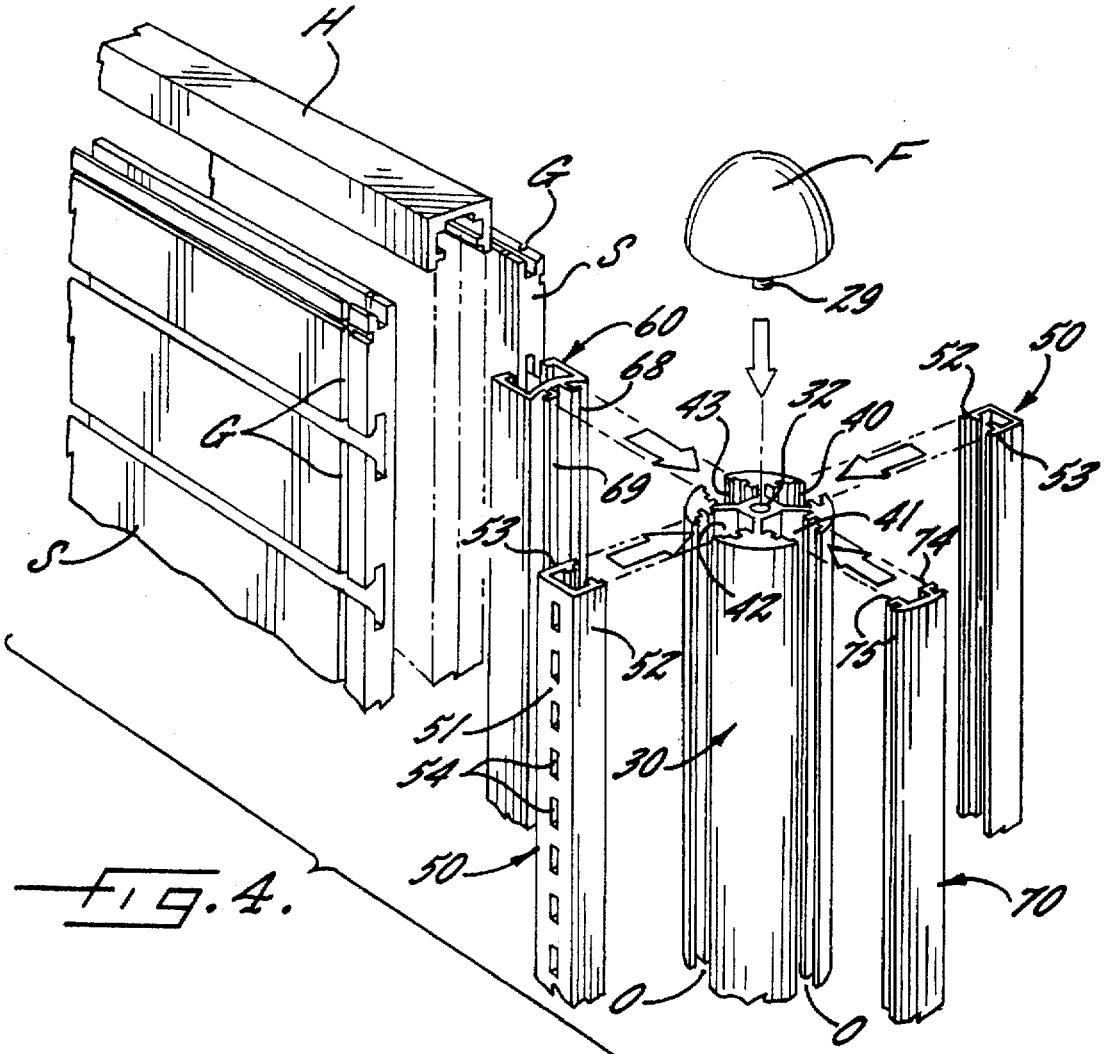
FIG. 4 is an enlarged exploded perspective view, with parts broken away, illustrating the connection of the back-to-back slatwalls and the slotted channels shown in FIG. 1 to three of the holding areas in one of the columns and the concealment of the unused holding area by a trim cap.
Figure 5:
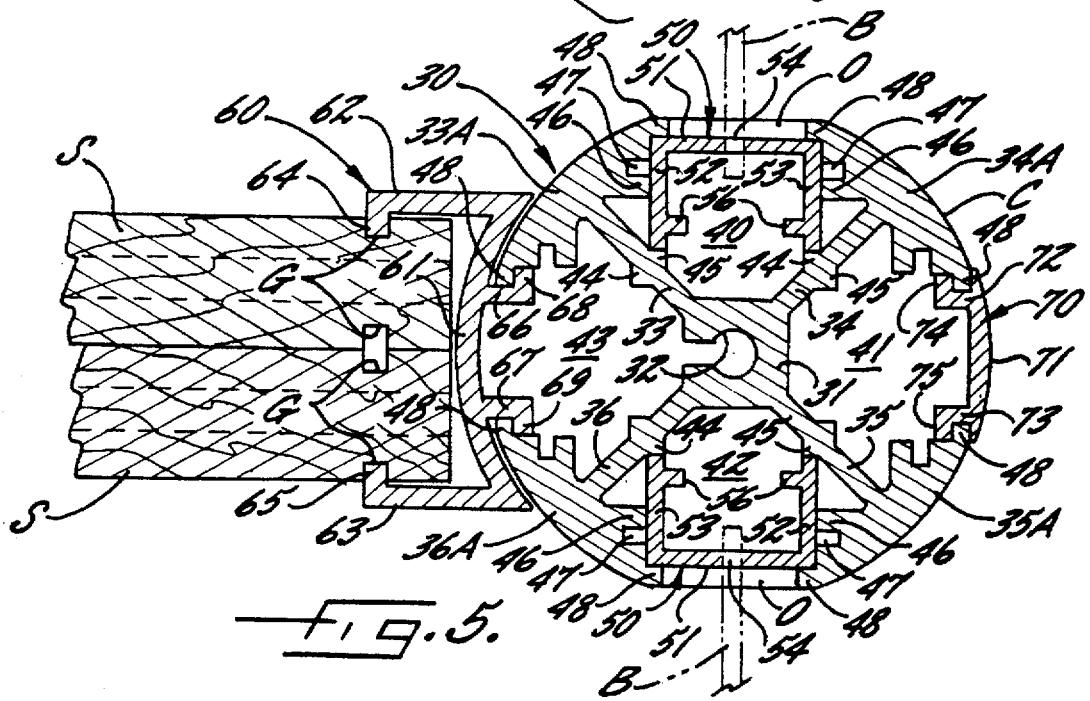
FIG. 5 is an enlarged sectional view taken substantially along the line 5—5 in FIG. 2.
Figure 6:
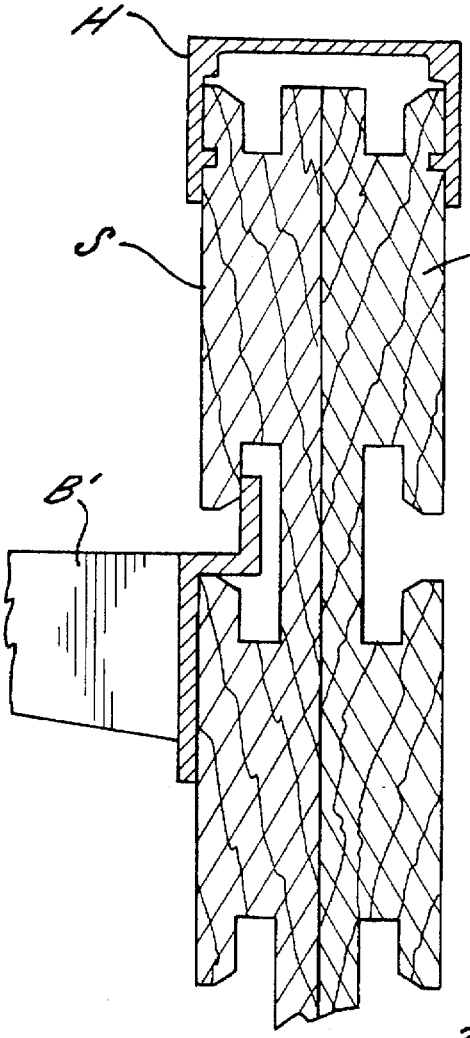
FIG. 6 is an enlarged sectional view taken substantially along the line 6—6 in FIG. 2.

FIGS. 3, 4 and 5 illustrate the structure of the extruded column 30. At the center of the column 30 is a square core 31 having an axial bore 32. Arms 33, 34, 35 and 36 extend radially at 90° angles from the corners of the square core 31 and terminate in arcuate segments 33A, 34A, 35A and 36A on the circumference of the column 30. Segments 33A–36A are equally spaced from each other with openings O between them. The segments 33A–36A form spaced portions of the circular wall C of the column.

The arms 33–36 define outwardly diverging spaces between them. The spaces between the arms serve as holding areas 40, 41, 42 and 43. The holding areas extend along the arms 33–36 from the square core 31 to the inner surfaces of the segments 33A–36A and become the openings O between the outer flanges 48 in the holding areas 40–43.

The outer flanges 48 in the holding areas 40–43 are spaced three quarters (¾) of an inch apart and the openings O are of the same width. This thickness corresponds with the standard thickness of conventional slatwalls S, panels P, double sided extruded slatwalls 120 and wire slat grid panels W.

Figure 10:
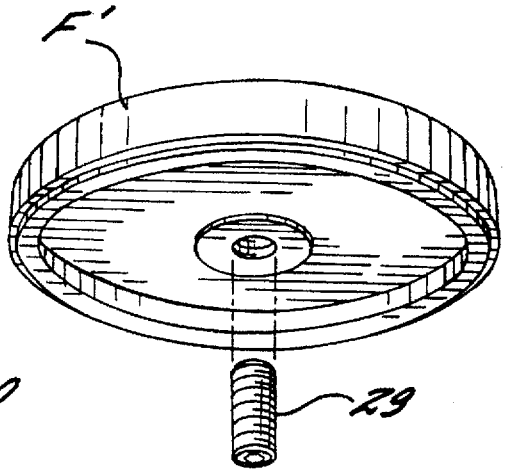
FIG. 10 is a perspective view looking up at one of the flat finials shown at the tops of the columnar supports in FIG. 9.

The holding areas 40–43 normally communicate with the ambient atmosphere at the top and bottom of the column 30, as seen in FIG. 3, but the top of the column can be closed by one of the finials F or $F^1$, as shown in FIGS. 3 and 10, and fastened by a bolt 29 threaded in the axial bore 32 of the column 30.

The mid portion of each of the arms 33–36 has opposed enlargements that function as abutments or stops 44 and 45, and the inner surfaces of the arcuate segments 33A–36A have uniform surface irregularities forming inner flanges 46, channels 47 and outer flanges 48 that engage and hold selected connectors within the holding areas 40–43.

The Slotted Inserts

There are three slotted inserts—the slotted channels 50, the slotted strips L and the reinforced slotted strips R.

The Slotted Channels

The slotted channels 50 are elongated three-sided channels of rectangular configuration cut to the same length as the column 30 with which they are intended to be used. The channel 50 comprises a web 51 and legs 52 and 53 that extend perpendicularly from the web 51 and in parallel relation to each other (FIG. 4). The web 51 of the slotted channel 50 has vertically spaced slots 54 that conform with the sparing of lugs 55 on brackets B conventionally used with slotted channels. Inturned flanges 56 extend toward each other from legs 52 and 53 of the slotted channel 50.

The shape and dimensions of the slotted channel 50 loosely conform with the placement and dimensions of the abutments 44 and 45 on the arms 33–36 and the flanges 46 and 48 on the segments 33A–36A (FIGS. 4 and 5) so that the slotted channel 50 will easily slide in place within any of the holding areas 40–43 and be retained therein by opposed outer flanges 48. The slotted channel 50 may be slid in place from either the top or bottom of the column 30. So positioned, the slotted channel 50 is radially interlocked with the column 30.

Figure 1:
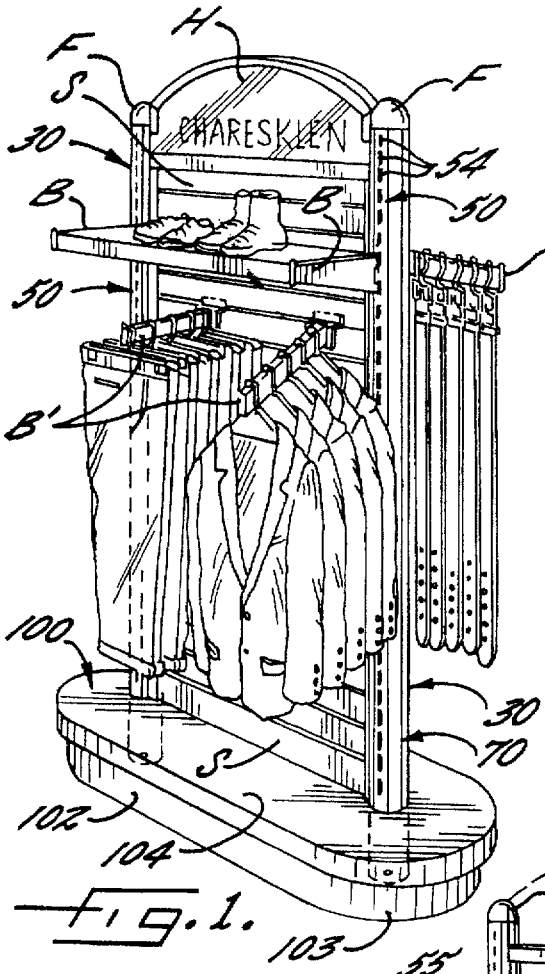
FIG. 1 is a perspective view showing two columnar supports with holding areas that are connected to back-to-back slatwalls, with holding areas that are connected to brackets for the display of clothing and with a holding area closed by a trim cap.
Figure 2:
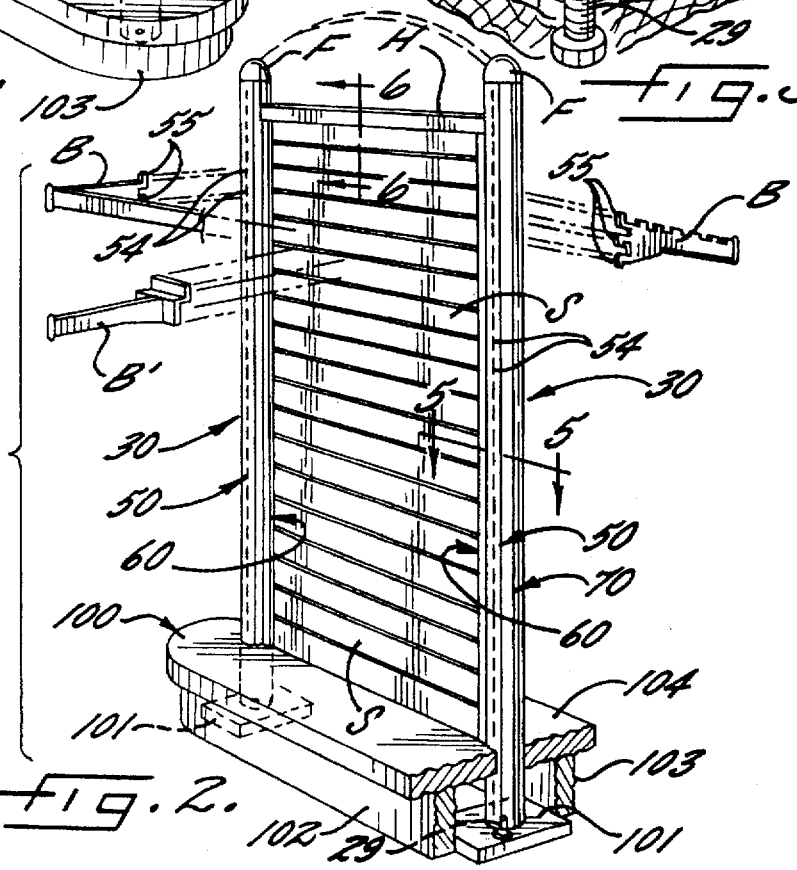
FIG. 2 is a partially exploded perspective view, with parts broken away, illustrating the connection of brackets to the slotted channels in holding areas of the columns shown in FIG. 1, and showing a trim cap in an unused holding area.

The slotted channel 50 may be positioned in any one of the holding areas 40–43 with the slotted web 51 facing outwardly and the legs 52, 53 extending toward the core 31 (FIGS. 1, 2 and 5).

The Slotted Strip L

Figure 19:
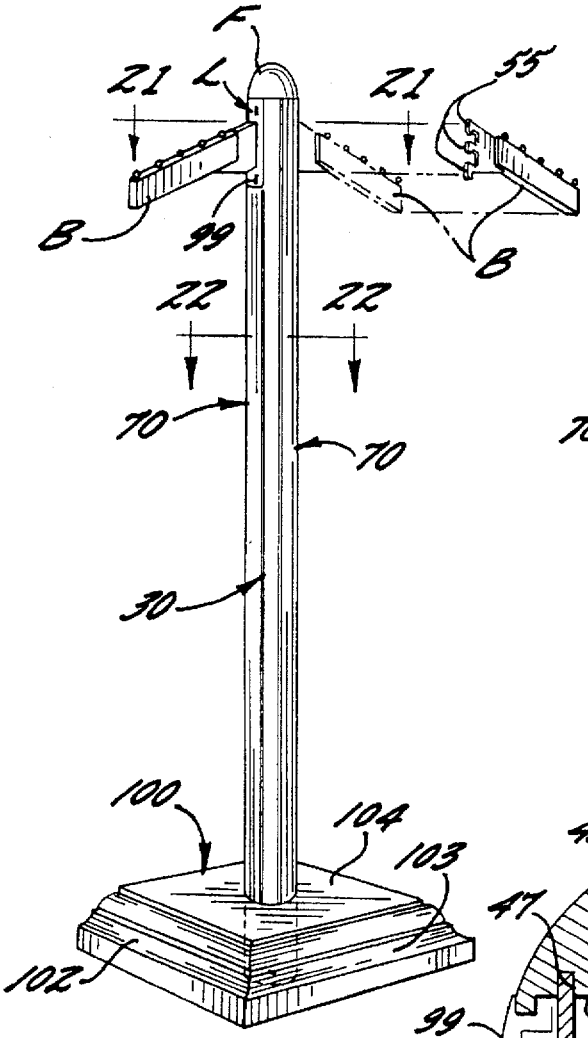
FIG. 19 is a perspective view showing two brackets connected to opposed holding areas of a single columnar support and trim caps concealing the unused holding areas to provide the appearance of a solid column used as a costumer.
Figure 20:
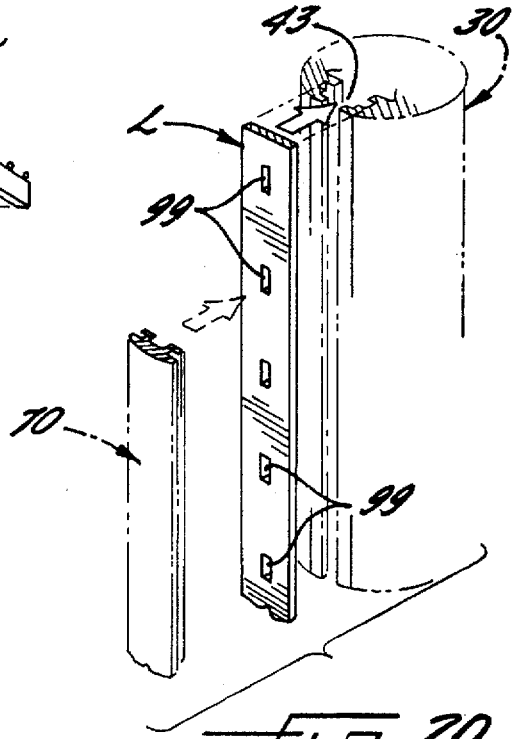
FIG. 20 is an exploded perspective view, with parts broken away, illustrating the connection of one of the slotted strips and one of the trim caps to one of the holding areas in the columnar support shown in FIG. 19.
Figure 21:
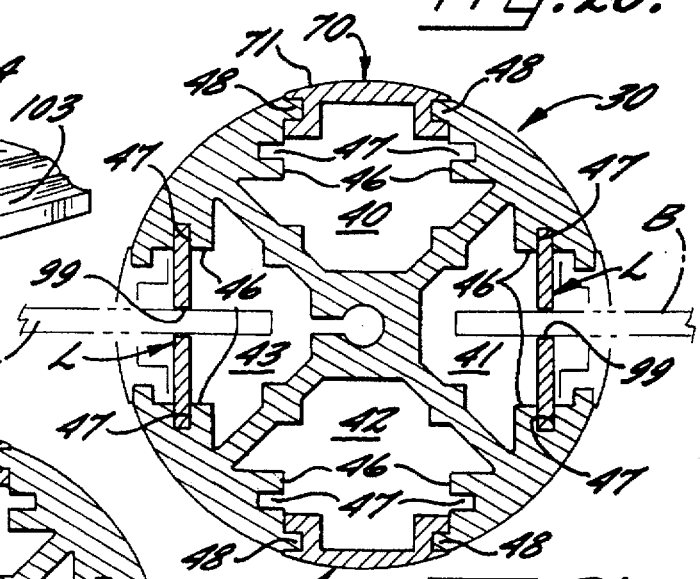
FIG. 21 is an enlarged sectional view taken substantially along the line 21—21 in FIG. 19.
Figure 22:
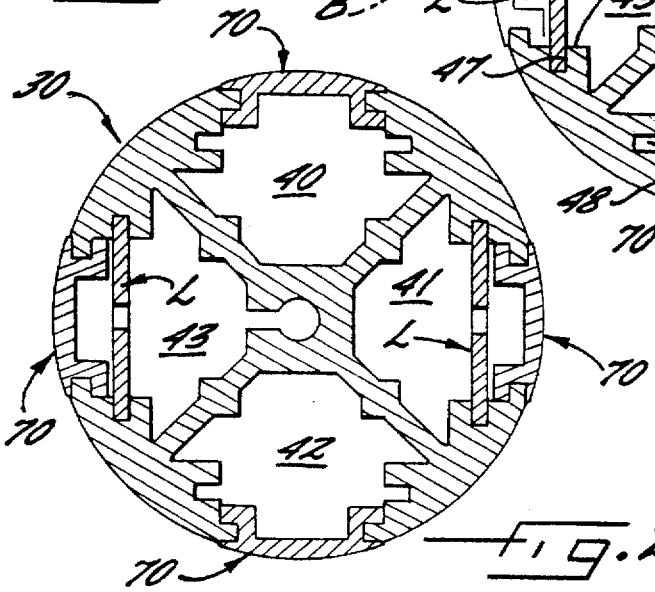
FIG. 22 is an enlarged sectional view taken substantially along the line 22—22 in FIG. 19.

The slotted strip L is an elongated strip of metal that has vertically spaced slots 99 that conform with the spacing of lugs 55 on brackets B as seen in FIGS. 19 and 20. The slotted strips L are slidably received, and retained, in the opposed channels 47 in any one of the holding areas 40–43. FIGS. 21 and 22 show the slotted strips L in holding areas 41 and 43.

The Reinforced Slotted Strip R

Figure 27:
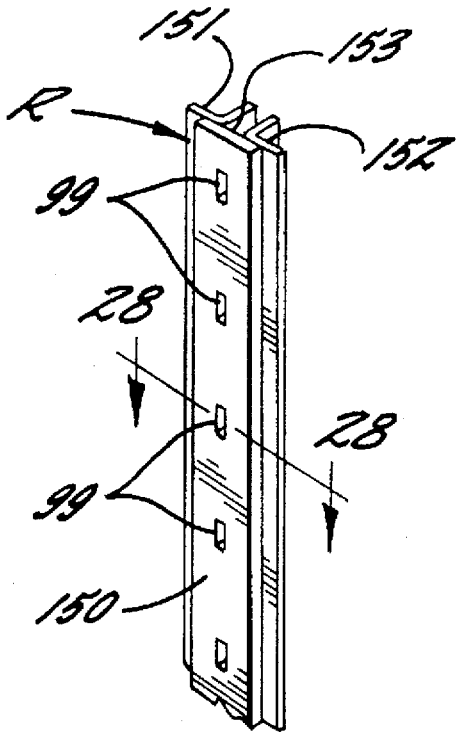
FIG. 27 is a perspective view looking at the rear of a reinforced slotted strip.
Figure 28:
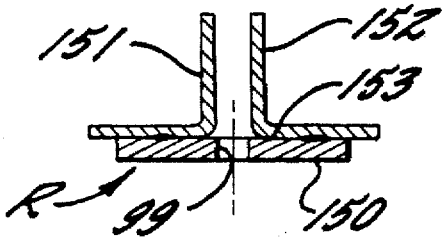
FIG. 28 is an enlarged sectional view taken substantially along the line 28—28 in FIG. 27.

The reinforced slotted strip R is made from an elongated strip of steel 150 that has vertically spaced slots 99 (FIG. 27). The slots 99 conform with the spacing of lugs 55 on brackets B in the same manner as the slots 99 in the slotted strips L. The strip 150 is made from ⅛ inch thick steel and two angle irons 151 and 152. The angle irons 151 and 152 are made from thinner steel than the strip 150 and are welded to the front surface 153 of the strip 150 on opposite sides of the vertical row of slots 99.

Figure 29:
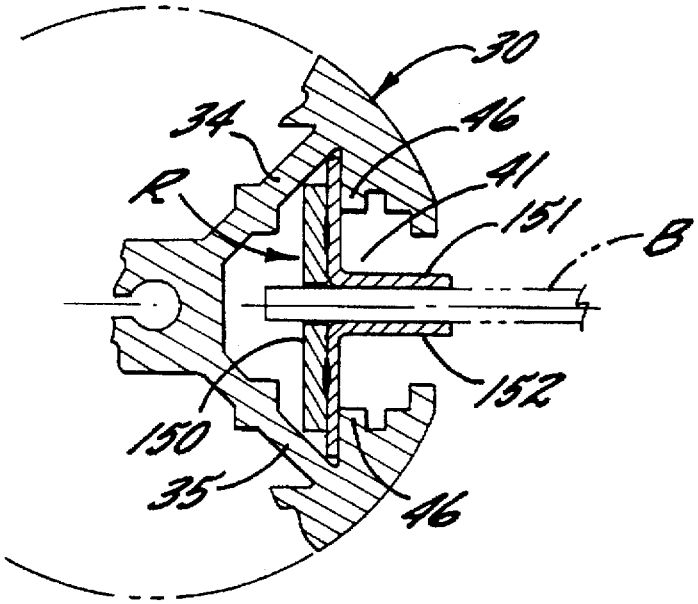
FIG. 29 is a fragmentary sectional view of the column showing the reinforced slotted strip supporting a bracket in one of the holding areas.

The reinforced slotted strips R are slidably received, and frictionally retained, between the inner flanges 46 and the corresponding arms defining any of the holding areas 40–43. FIG. 29 shows a reinforced slotted strip R frictionally retained in holding area 41 between inner flanges 46 and arms 34 and 35.

The Internal Channel

The internal channel $50^1$ has a web $51^1$ and legs $52^1$, $53^1$ with inturned flanges $56^1$ of the same structure and dimensions as the slotted channel 50, except that the web $51^1$ of the internal channel $50^1$ has no slots.

Figure 11:
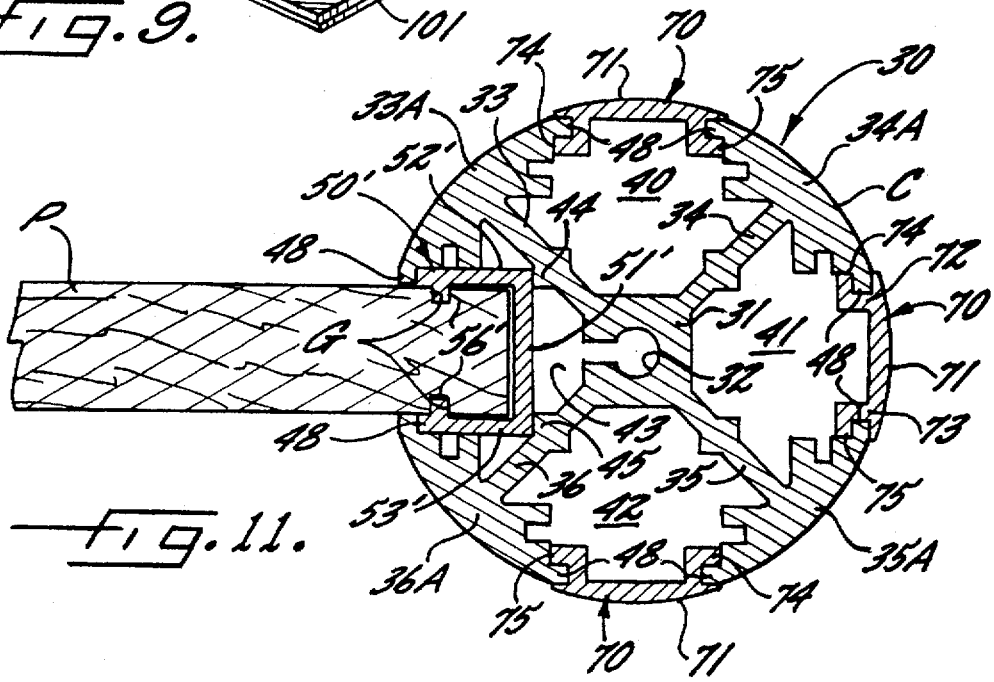
FIG. 11 is an enlarged sectional view taken substantially along the line 11—11 in FIG. 9.

In use, the internal channel $50^1$ may be positioned in any one of the holding areas 40–43 with the web $51^1$ facing inwardly toward the core 31 and the legs $52^1$ and $53^1$ extending outwardly to receive a standard ¾ inch panel P. FIG. 11 shows an internal channel $50^1$ positioned in holding area 43 with the flanges $56^1$ engaging the usual grooves G in a panel P.

The Double-wall Channel

As has been noted, the openings O to the holding areas 40–43 are the same width as that of the standard ¾ inch panels P and slatwalls S so that a panel P or slatwall S can be held in a holding area by an inverted channel $50^1$.

Figure 8:
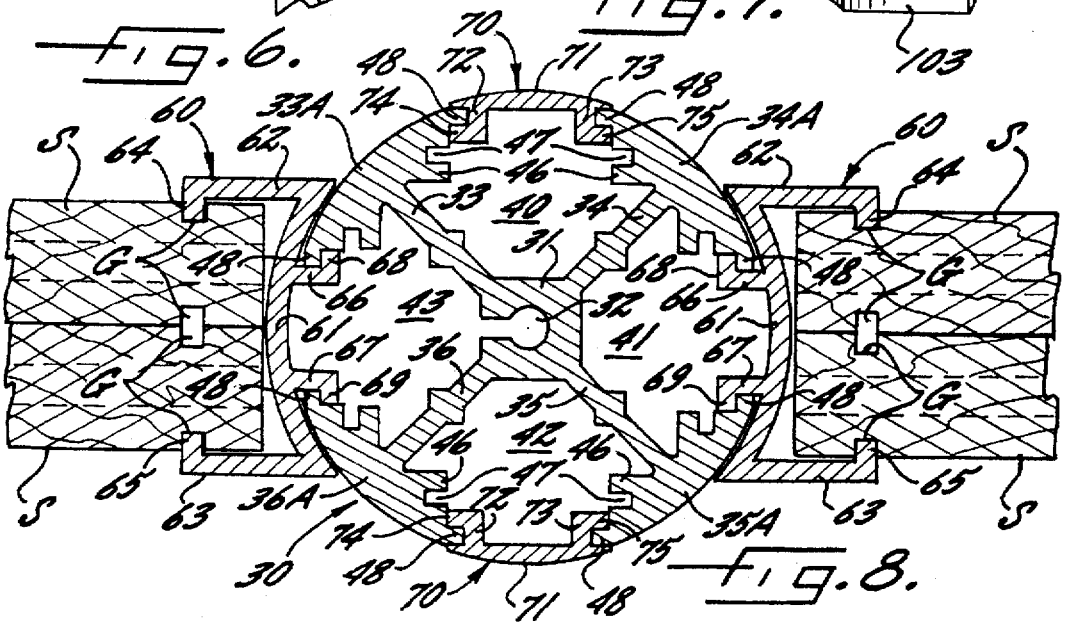
FIG. 8 is an enlarged sectional view taken substantially along the line 8—8 in FIG. 7.

The double-wall channel 60 extends the utility of the column 30 to support two ¾ inch panels arranged back-to-back; or, if desired, one ¾ inch panel P and one ¾ inch slatwall S arranged back-to-back, or two ¾ inch slatwalls arranged back-to-back as in FIGS. 4, 5 and 8.

Each of the double-wall channels 60 is an elongated three-sided channel of generally rectangular configuration, comprising an arcuate web 61 and parallel legs 62 and 63 extending radially outwardly from the convex side of the web 61. Flanges 64, 65 extend perpendicularly toward each other from the outer ends of the legs 62, 63 to register with grooves G in the slatwalls S (FIGS. 4, 5 and 8).

Parallel legs 66, 67 extend radially inwardly from the concave side of the arcuate web 61. Flanges 68, 69 extend perpendicularly away from each other from the inner ends of the legs 66, 67 to seat behind the outer flanges 48 on two adjoining segments 33A–36A at the outer ends of the arms 33–36.

The Trim Cap

The trim caps 70 (FIGS. 4, 5, 8, 11, 16, 17, 21, 22 and 25) are elongated connectors that are used to cover and conceal holding areas 40–43 in the column 30 that are not in use. For this reason the outer portion 71 of the trim cap 70 is of arcuate configuration with an appearance that conforms with that of the arcuate segments 33A–36A on the outer ends of the arms 33–36. The inner portion of the trim cap 70 comprises short legs 72 and 73 that extend radially inwardly from the concave side of the arcuate outer portion 71. Flanges 74, 75 extend perpendicularly away from each other from the inner ends of the legs 72, 73 to seat behind the outer flanges 48 on any two adjoining segments, such as the segments 33A–36A at the outer ends of the arms 33–36.

The Base

As indicated in FIGS. 1,2, 9 and 19, the bottom of a display supported by columns 30 is closed by a sizable base 100 when the display is other than an angled partition. A typical construction of the base 100 is illustrated in FIG. 2. The base 100 is built with some height to provide the leverage necessary to support in an upright position either the merchandiser island of FIG. 1, the slatwall S of FIG. 7, the directory/sign holder of FIG. 9, the three way display of FIG. 14, or the single column 30 forming a costumer in FIG. 19. In each instance the bottom of the column 30 is closed by a bottom wall 101. Side walls 102 and end walls 103 extend upwardly from the bottom wall to a top wall 104.

The Planar Connector

Figures 23, 24:
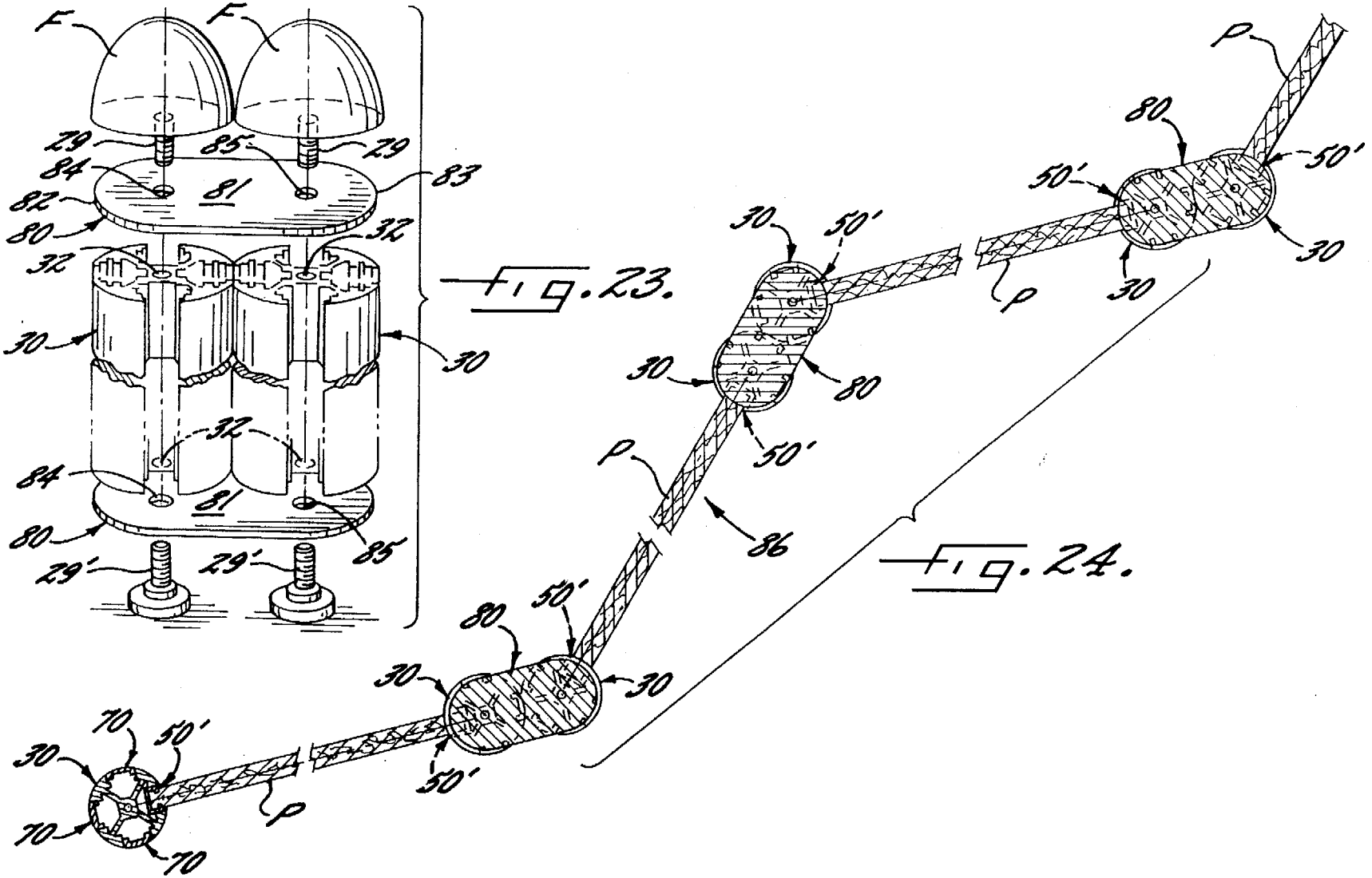
FIG. 23 is an exploded perspective view, with parts broken away, showing the pivotal connection of two columnar supports by a planar connector.
FIG. 24 is a top plan view showing the planar connector of FIG. 23 used with columnar supports for fastening panels at variable angles to form a self-supporting partition or display without the need for a supporting base.

The planar connector 80 (FIGS. 23 and 24) is a flat plate 81 of suitably sturdy stock, such as a ⅜ inch metal plate. The flat plate 81 has a length substantially equal to twice the diameter of the column 30 and has curved ends 82 and 83 that overlie two columns 30 in close juxtaposition with each other as seen in FIG. 23. The flat plate 81 has two openings 84 and 85 spaced from each other sufficiently to register with the axial passageways 32 through the two juxtaposed columns 30.

Planar connectors 80 pivotally connect the top and bottom of two adjoining columns 30 in close juxtaposition for the purpose of forming a pivotable self-standing angled partition, such as indicated at 86 in FIG. 24. One advantage of an angled partition is that it eliminates the need for the cumbersome base that is needed to support a straight wall or partition. This is advantageous in trade show exhibits that are repetitively moved and reassembled. The size and weight of bases that are adequate to support partitions renders them undesirable for traveling exhibits.

The Pivotal Connector

The pivotal connector 90 (FIGS. 25 and 26) also permits the formation of self-standing angled partitions, such as indicated at 98, without the need for a base sturdy enough to support the partition. The pivotal connector is advantageous over the planar connection because the pivotal connector 90 connects a column 30 with a panel, while the planar connector 80 connects a column 30 to only another column 30.

Two columns 30 are required at each juncture of panels in an angled partition.

The pivotal connector 90 comprises an elongated tube or cylinder 91 joined to an equally elongated three-sided rectangular channel 92. The channel 92 comprises a web 93 and legs 94, 95 extending perpendicularly from the web 93 in parallel relation to each other. Inturned flanges 96 extend toward each other from the legs 94, 95 to register with opposed grooves G in conventional slatwalls or sign panels P ( FIG. 25), or the like. The channel 92 is a replica of the internal channel 50$^1$ except that the web 93 of the channel 92 supports one end of a flange 97 that joins the channel 92 with the cylinder 91.

The outer diameter of the cylinder 91 spans the same distance as the width of the web 51$^1$ of channel 50$^1$. That distance is greater than the span between outer flanges 48 in each of the holding areas 40–43, so that the cylinder 91 is retained in a holding area by the outer flanges 48. At the same time the cylinder 91 is sufficiently spaced from the inner flanges 46 and abutments 44 and 45 in the holding area to be freely rotatable within the column 30. As seen in FIG. 25, the rotatable feature enables panels P to extend at different angles from the column 30. This is particularly desirable in the erection of exhibit booths without the need for a cumbersome base.

Double-Sided Extruded Slatwall

Double-sided extruded slatwalls are generally known. They are made of different strengths and thicknesses, and with different capabilities. Some double-sided extruded slatwalls are made with the spacing of the slats being such that it will not register with conventional brackets and hardware but will accommodate only brackets and hardware specially made to conform with that spacing.

The double-sided extruded slatwall used with this invention has the standard ¾ inch width and the spacing of the slats conforms with the conventional brackets and hardware used with conventional slatwalls.

Figure 13:
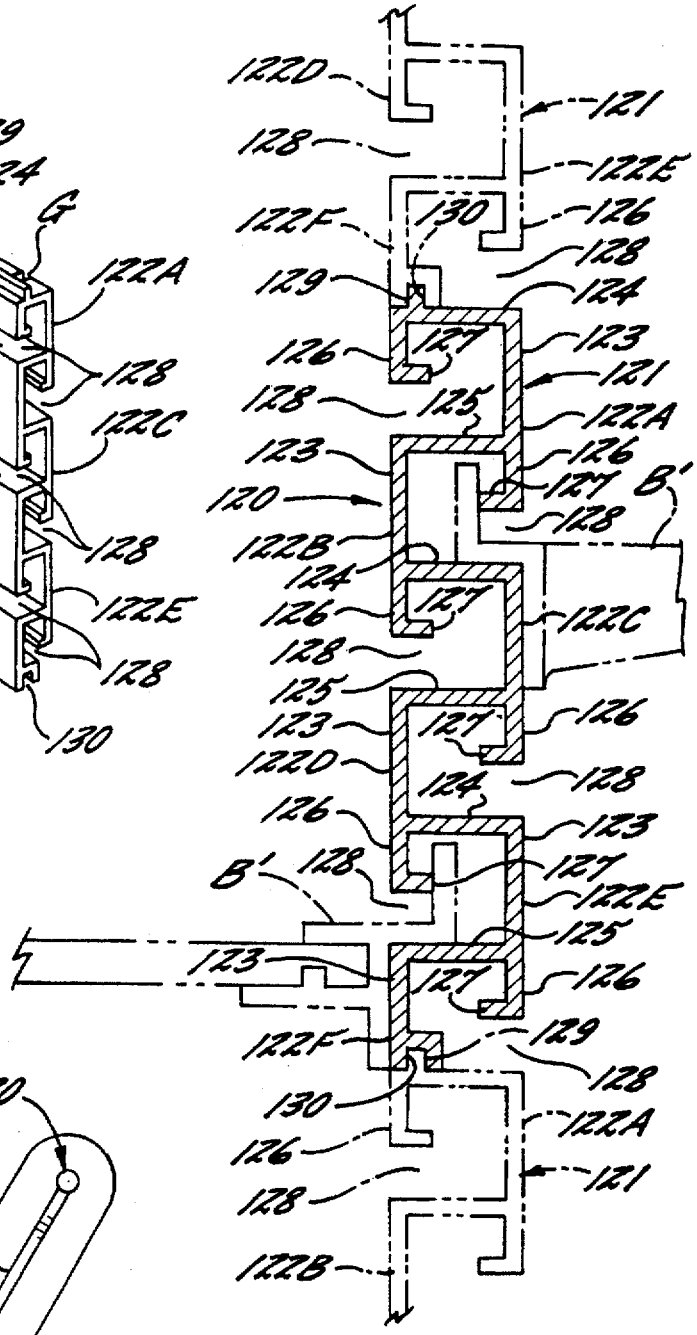
FIG. 13 is an enlarged sectional view taken substantially along the line 13—13 in FIG. 12.

A double-sided extruded slatwall of the type used with this invention is broadly indicated at 120 in FIG. 13. The double-sided extruded slatwall 120 functions as does the conventional wooden slatwall S to support brackets B$^1$ for the display of merchandise.

The double-sided extruded slatwall 120 is formed from sections 121 (FIG. 12) which are extruded from suitably sturdy material such as medium to heavy gauge aluminum. The extruded sections 121 are subsequently interconnected as shown in FIG. 13 to form the double-sided slatwall 120.

Figure 12:
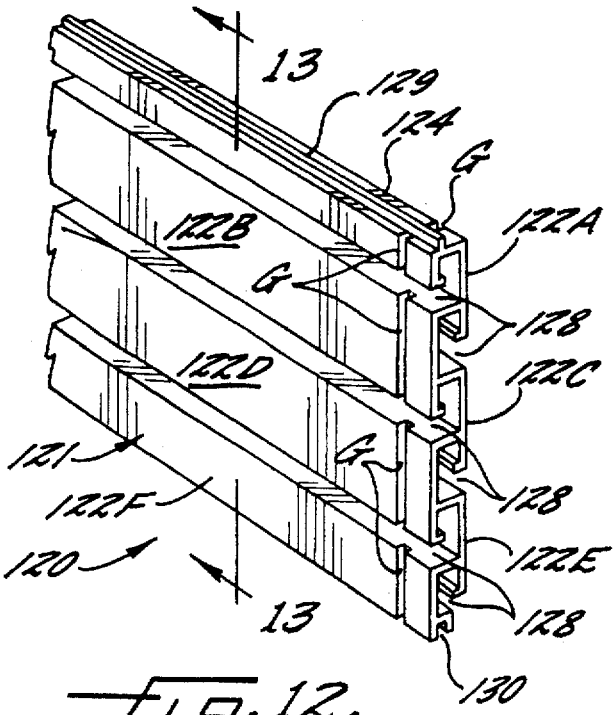
FIG. 12 is a perspective view, with parts broken away, of a double sided extruded slatwall.

Each extruded slatwall section 121 comprises a plurality of integrated channels (six channels being shown at 122A–122F in the illustration of FIG. 12). Each of the channels 122A–122F comprises a web 123 and parallel legs 124 and 125 extending perpendicularly from the ends of the web 123. A short leg 126 extends downwardly in FIG. 13 from the end of leg 124 opposite the web 123. The free end of the leg 126 is spaced from the leg 125 and the leg 126 terminates in an inturned tongue 127, leaving an opening 128 opposite the web 123. It will be noted that the openings 128 in the channels 122A–122F face in opposite directions, enabling the double-sided extruded slatwall 120 to support brackets and shelves facing in opposite directions, as indicated in FIG. 13.

A tongue 129 extends longitudinally of channel 122A along the leg 124, and the channel 122F has a longitudinally extending groove 130 inside the web 123. The tongue 129 of one section 121 fits in the groove 130 of an adjoining section 121, as best seen in FIG. 13, to connect the sections.

The webs 123 are grooved as at G near the end of each section 121 to register with the inwardly extending flanges 56$^1$ on the internal channel 50$^1$ when it is desired to support the double-sided extruded slatwall 120 by columns 30.

Wire Slat Grid Panel

Wire slat grid panels are conventionally used in the same manner as wooden slatwalls to support brackets and shelving for the display of merchandise. Wire slat grid panels are formed from wire and are frequently arranged in triangular or rectangular patterns, for which bases are not needed. Wire slat grid panels are also conventionally supported on bases that are custom made for use in a specific location.

The columnar supports of this invention can provide support in any desired location for conventional wire slat grid panels. FIGS. 15–18 illustrate the use of columnar supports with conventional wire slat grid panels (grid panels W). As shown in those Figures, a grid panel W is formed from lengths of heavy gauge wire that are welded together to form grids with appropriate spacing to receive conventional brackets B$^1$.

Figure 15:
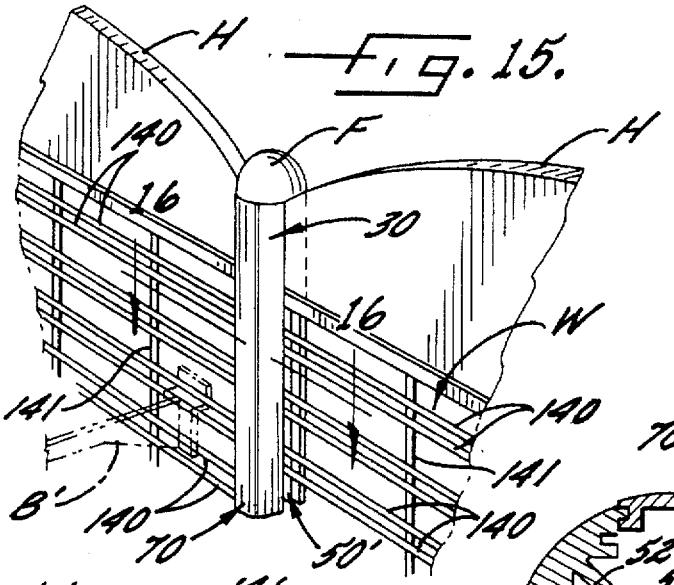
FIG. 15 is a perspective view, with parts broken away, showing one columnar support between two wire slat grid panels and a trim cap in an unused holding area.

The grids in a grid panel W are formed with pairs of wires 140 extending in one direction and single wires 141 extending perpendicularly to the direction of the pairs of wires. (horizontally and vertically as shown in the drawings). The two wires in each pair 140 are appropriately spaced to receive the upper portion of a bracket B$^1$ and the pairs 140 are appropriately spaced to receive the lower portion of the bracket B$^1$ in a well-known manner, as shown in FIGS. 15 and 18. At the ends of the grid panels W, two vertical wires 141 are provided and welded to opposite sides of the horizontal pairs of wires 140, as at 142 in FIGS. 16–18.

Figure 16:
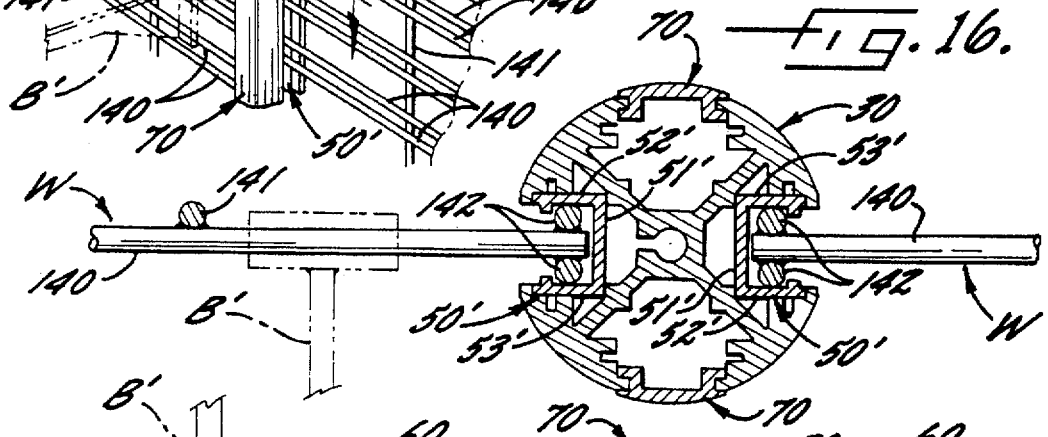
FIG. 16 in an enlarged sectional view taken substantially along the line 16—16 in FIG. 15.

FIGS. 15 and 16 illustrate the support of a single grid panel W by columnar supports 30, wherein the end wires 142 of a grid panel W are received and held in the channel of an inverted channel 50$^1$.

Figure 17:
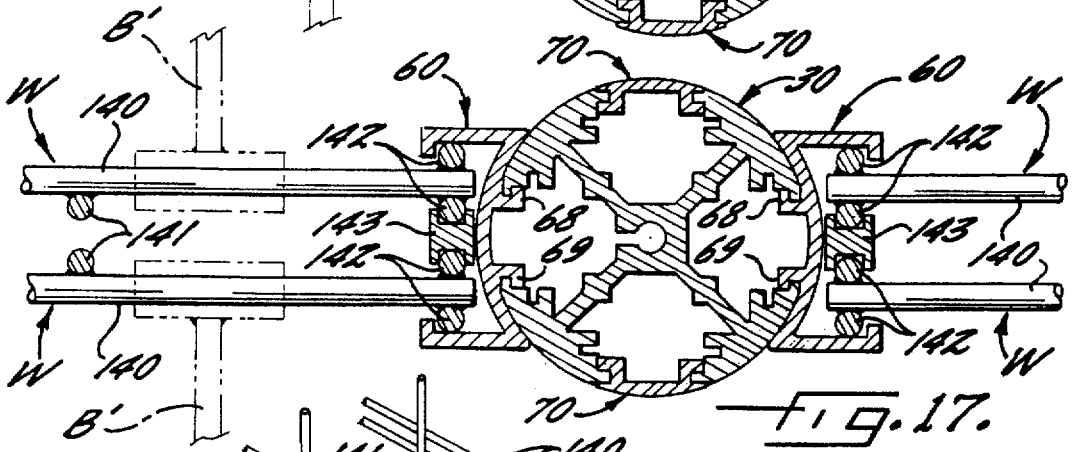
FIG. 17 is a view similar to FIG. 16, but showing a columnar support used to support two back-to-back wire slat grid panels.
Figure 18:
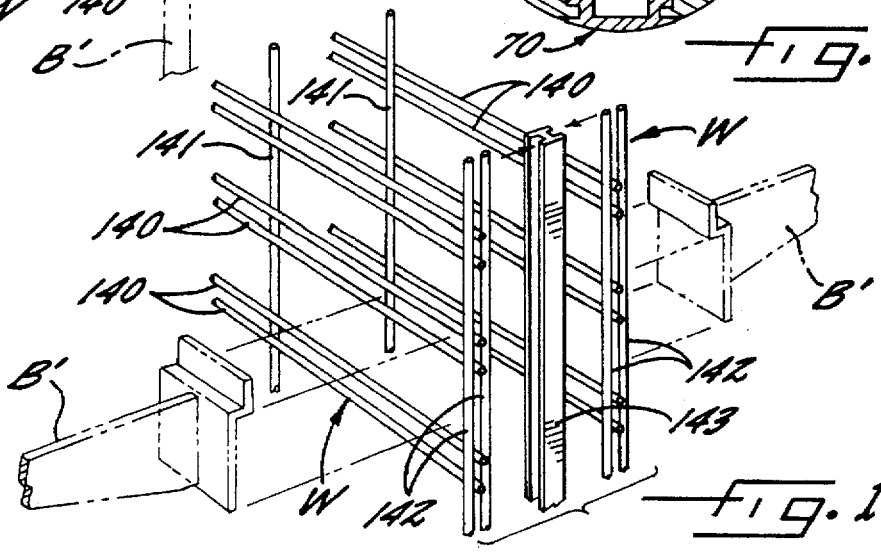
FIG. 18 is an exploded perspective view, with parts broken away, of the back-to-back wire slat grid panels shown in FIG. 17.

It is customary to place two grid panels W back-to-back as shown in FIGS. 17 and 18 when it is desired to provide a double display. The two grid panels W are then arranged with the vertical wires 141 on the inside, between the two grid panels W. Double-wall channels 60 are used to attach the back-to-back grid panels to a columnar support 30, with a spacer 143 extending between the innermost end wires 142 (FIG. 18).

The Functions of The Columnar Support

Some of the many functions of the columnar support are illustrated in the drawings.

The Merchandiser Island (FIG. 1)

The merchandiser island of FIG. 1 is built from a slatwall S supported by two columns 30 and a base 100. Clothes are hung from brackets B and B$^1$ extending in a conventional manner from the slotted channel 50 and the slatwall S. The slatwall S is fastened to each of the two columns 30 by internal channels 50$^1$. The holding area 41 that is not closed by either the slotted channels 50 or the double-wall channel 60 in the merchandiser island of FIG. 1 is closed by a trim cap 70 for aesthetic purposes. Finials F close the tops of the columns 30, and a header H extends between the two columns 30. The header H is fastened to the columns 30 by internal channels 50$^1$ with the legs 52$^1$ and 53$^1$ extending outwardly and the slotted web 51$^1$ facing inwardly as shown in FIG. 11.

Figure 7:
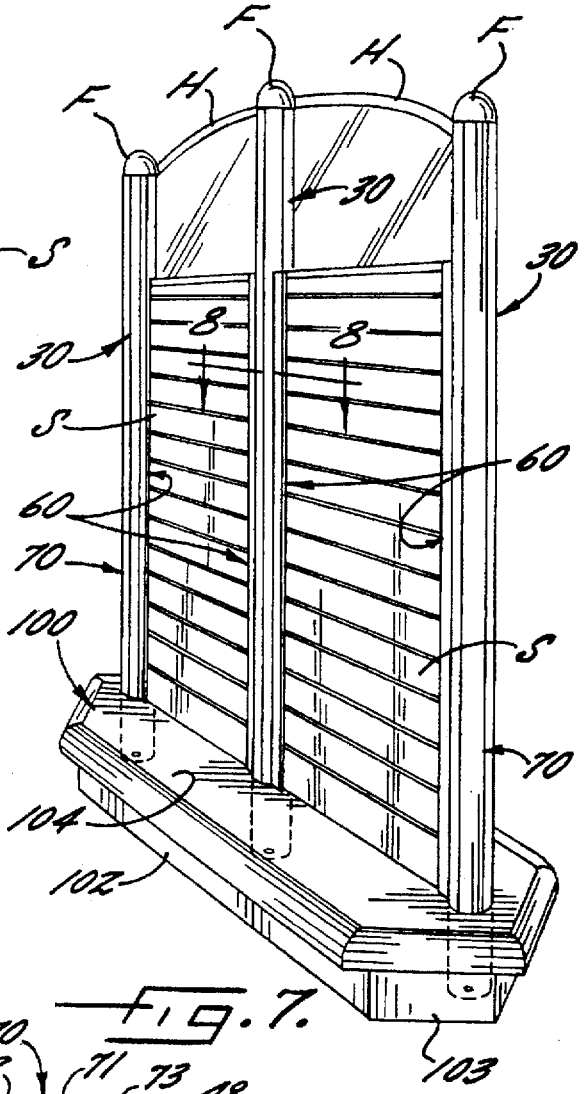
FIG. 7 is a perspective view showing three columnar supports attached to side-by-side slatwalls.

Three Column Fixture (FIG. 7)

FIG. 7 shows two double-sided slatwalls supported by three columns 30 on a base 100. The double-sided slatwalls S are fastened to the columns 30 by double-wall channels 60, in the manner previously described. Trim caps 70 close the unused holding areas in the columns 30.

Figure 9:
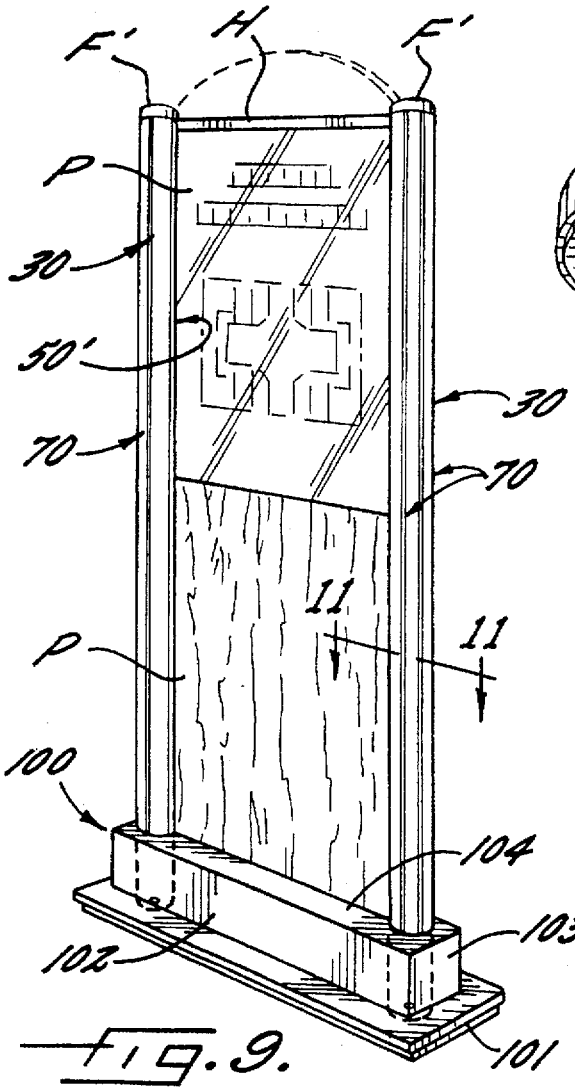
FIG. 9 is a perspective view showing a decorative panel or sign board connected to individual holding areas in two columnar supports with trim caps in the unused holding areas.

Directory/Sign Holder (FIG. 9)

FIG. 9 shows a directory/sign holder supported between two columns 30 on a base 100. The directory/sign holder is fastened to the columns 30 by internal channels $50^1$ that are positioned in the columns 30 with the legs $52^1$ and $53^1$ extending outwardly and the flanges $56^1$ engaging the grooves G in the panels P in the directory/sign holder. The unused holding areas are concealed by trim caps 70.

Figure 14:
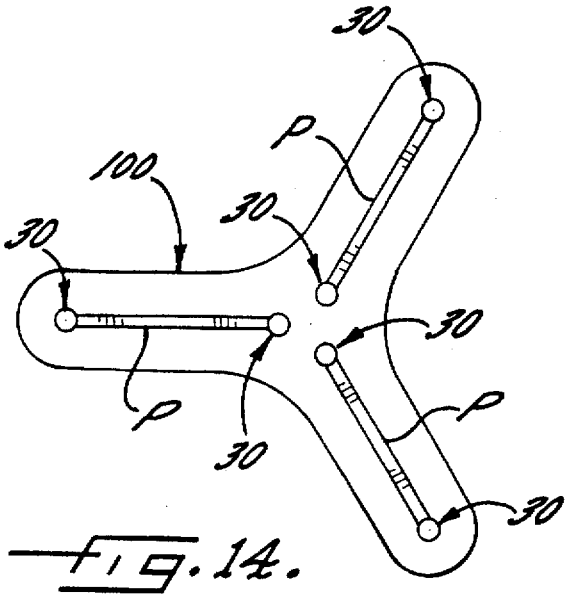
FIG. 14 is a top plan view of six columnar supports attached to three panels spaced 120° from each other on a base to form a three-way display.

Three-Way Wall Section (FIG. 14)

FIG. 14 shows a three-way wall section utilizing six columns 30 to support three panels P on a base 100. The panels P are fastened to the columns 30 by internal channels $50^1$ with the flanges $56^1$ on the channels $50^1$ engaging grooves G in the panels P, in the manner shown in FIG. 11.

Costumer (FIG. 19)

FIG. 19 shows a costumer composed of a single columnar support and a base 100. The columnar support comprises a column 30, a finial F, slotted strips L in opposed holding areas of the column 30, brackets B supported beneath the finial F by the slotted strips L, and a trim cap 70 in each of the four holding areas 40–43 in the column 30 (FIG. 22).

The slotted strips L have longitudinally spaced slots 99 that receive the spaced lugs 55 of conventional brackets B. The strips L extend the full length of the column 30 and are illustrated in FIGS. 19–22 as being retained in holding areas 43 and 41. Specifically, the slotted strips L are positioned and retained in channels 47 in adjoining arcuate segments 33A, 36A and 34A–35A (FIGS. 21 and 22). Two of the trim caps 70 also occupy the holding areas 43 and 41, and are shortened to expose enough of the slotted channels L to provide support for the brackets B. The remainder of holding areas 43 and 41 are closed by trim caps 70 and full length trim caps 70 are positioned in the remaining holding areas 40 and 42 to provide the appearance of a solid column for aesthetic purposes.

There is thus provided a columnar support which is adaptable for use in a great variety of ways to provide reliably effective and attractive support for the display of merchandise.

Although specific terms have been used in describing the invention, they have been used in a generic and descriptive sense only and not for the purpose of limitation.

I claim:

1. A columnar support for conventional items of hardware selected from a group of conventional hardware items that are normally used in the display of merchandise, the columnar support comprising a tubular column having a core and the tubular column including:

(a) a plurality of holding areas diverging outwardly from the core, (b) a plurality of connectors, each connector including an inner portion and an outer portion, (c) each holding area including means for frictionally retaining the inner portion of each connector, and (d) the outer portion of each connector including means for frictionally retaining one item in said group of conventional hardware items, whereby each item of conventional hardware in said group of conventional hardware items can be supported in any selected holding area in the tubular column.

2. The invention of claim 1 wherein the means for supporting any item of conventional hardware conventionally used to display merchandise comprises connectors selected from a group of connectors including slotted channels, internal channels, slotted strips, reinforced slotted strips, double-wall channels and pivotal connectors.

3. The invention of claim 2 wherein the items of conventional hardware that are conventionally used to display merchandise comprise items selected from a group of items including slatwalls, double-sided extruded slatwalls, wire slat grid panels, slotted strips, reinforced slotted strips, panels and brackets.

4. The invention of claim 1 wherein the means for concealing holding areas that are not used to support an item of conventional hardware comprises trim caps.

5. A method of using any item of conventional hardware selected from a group of conventional hardware items that are normally used in the display of merchandise, said method comprising the steps of:

(a) selecting from the group of conventional hardware items those items of conventional hardware that are to be used in the intended display of merchandise, (i) the group of conventional hardware items including slatwalls, double-sided extruded slatwalls, wire slat grid panels, slotted strips, reinforced slotted strips, panels and brackets, (b) providing a tubular column having a plurality of radially extending holding areas and each holding area including means for frictionally retaining the inner portion of a connector that will connect a selected item of conventional hardware to a selected holding area, (c) providing a group of connectors, each connector including an inner portion to be frictionally retained in a selected holding area and an outer portion including means for frictionally retaining one item in said group of conventional hardware items, (i) the group of connectors including slotted channels, internal channels, slotted strips, reinforced slotted strips, double-wall channels and pivotal connectors, (d) selecting connectors from said group of connectors that have inner portions shaped for frictionally retaining the items selected from said group of conventional hardware items, (e) positioning the inner portions of selected connectors in selected holding areas in the tubular column; and (f) connecting the items selected from said group of conventional hardware items to the outer portions of corresponding selected connectors.

6. A columnar support adaptable for use with different items of conventional hardware and panels normally used to display merchandise in stores and exhibit halls, the columnar support comprising:

(a) a tubular column extruded from a heavy gauge material and cut to desired lengths, the tubular column including a core and having holding areas diverging radially from the core, each holding area including means for frictionally retaining the inner portion of a connector for an item of conventional hardware, (b) a group of connectors, each connector including:

(i) an inner portion including means for frictional retention in a selected holding area in the tubular column, and (ii) an outer portion including means for frictionally retaining an item of conventional hardware, whereby selected displays of merchandise are supported by the columnar support.

7. The invention of claim 6 wherein a display of merchandise on a slatwall is provided, the slatwall being supported by:

(a) two of the said columnar supports spaced apart from each other;

(b) one of the selected items of conventional hardware being a slatwall extending between the two columnar supports;

(c) two of the selected connectors being interior channels; and (d) the interior channels being positioned in opposed holding areas of the tubular columns and connected to opposite ends of the slatwall.

8. The invention of claim 6 wherein the tubular column includes:

(a) arms extending radially from the core and spaced 90° from each other to define the holding areas;

(b) each arm terminating in an arcuate segment that forms a portion of the circular wall of the column;

(c) opposed abutments extending into adjoining holding areas from the mid-portions of the arms;

(d) flanges extending into each holding area from the inner surfaces of adjoining arcuate segments; and (e) the inner surfaces of adjoining arcuate segments having channels with open ends extending into the holding area between the adjoining arcuate segments, whereby the connectors are slidably received and retained within the holding areas.

9. A columnar support adaptable for use with different items of conventional hardware and panels normally used to display merchandise in stores and exhibit halls, the columnar support comprising:

(a) a tubular column extruded from a heavy gauge material and cut to desired lengths, the tubular column including a core and having holding areas diverging radially from the core;

(b) a group of connectors, each connector including:

(i) an inner portion shaped to fit in any one of the holding areas and (ii) an outer portion shaped to conform with and be connected to at least one item of conventional hardware;

(c) means for retaining the inner portion of an connector in any holding area in the column while the outer portion of said connector is connected to an item of conventional hardware, whereby displays of merchandise are supported by the columnar support;

(d) a first group of two tubular columns in close juxtaposition to each other;

(e) a first pair of planar connectors;

(f) means connecting the first pair of planar connectors to the tops and bottoms of the two tubular columns in said first group of tubular columns;

(g) a first internal channel in one of the tubular columns in said first group of tubular columns;

(h) a first panel connected to the first internal channel;

(i) a second group of two tubular columns in close juxtaposition to each other;

(j) a second pair of planar connectors, (k) means connecting the second pair of planar connectors to the tops and bottoms of the two tubular columns in said second group of tubular columns;

(l) a second internal channel in one of the tubular columns in said second group of tubular columns;

(m) the second internal channel being connected to the end of the first panel opposite the first group of tubular columns;

(n) a third internal channel in one of the tubular columns in said second group of tubular columns;

(o) a second panel connected to the third internal channel and extending at less than 180° from said first panel;

(p) a third group of two tubular columns in close juxtaposition to each other;

(q) a third pair of planar connectors, (r) means connecting the third pair of planar connectors to the tops and bottoms of the two tubular columns in said third group of tubular columns;

(s) a fourth internal channel in one of the tubular columns in said third group of tubular columns; and (t) the fourth internal channel being connected to the end of the second panel opposite the second group of tubular connectors.

10. The invention of claim 9 which includes:

(a) a first tubular column;

(b) a first pivotal connector in said first tubular column;

(c) a first panel connected to said first pivotal connector and extending at a first angle from said first tubular connector;

(d) a second tubular column spaced from said first tubular column;

(e) a second pivotal connector in said second tubular column and connected to the end of the first panel opposite the first tubular column;

(f) a third pivotal connector in said second tubular column;

(g) a second panel connected to said third pivotal connector and extending from the second tubular column at an angle less than 180° to the first panel;

(h) a third tubular column spaced from said second tubular column; and (e) a fourth pivotal connector in said third tubular column and connected to the end of the second panel opposite the second tubular column.

11. A columnar support for conventional items of hardware selected from a group of conventional hardware items that are normally used in the display of merchandise, the columnar support comprising a tubular column, the tubular column having a core and the columnar support including an outer wall, four arms extending radially from the core at 90° angles to each other, an arcuate segment at the end of each arm, the arcuate segments being circumferentially spaced from each other and forming spaced portions of the outer wall of the column, the four arms and their arcuate segments defining holding areas between them, a group of connectors, each connector including an inner portion shaped to be slidably received and frictionally retained in any one of the holding areas and including an outer portion shaped to frictionally retain items of conventional hardware selected from the group of conventional hardware items, and a plurality of trim caps, each trim cap including an inner portion shaped to be slidably received and retained in any holding area in the tubular column and including an arcuate outer portion that conforms in appearance with the appearance of the arcuate segments that form spaced portions of the outer wall of the column, whereby the trim caps may be installed in all of the holding areas that are not used to support connectors, and whereby the trim caps cover and conceal the unused holding areas and whereby the trim caps extend between the spaced arcuate wall segments to provide the appearance of a solid column except for the active holding areas that support connectors and items of conventional hardware.

* * * * *